United States Patent [19]

V. Kuepach et al.

[11] 3,955,001

[45] May 4, 1976

[54] DUMPLING PACKAGE

[75] Inventors: Gerhard V. Kuepach, Hart, Germany; Karl Petutschning, Poing, Austria; Günter Kluge, Vaterstetten, Germany

[73] Assignee: Pfanni-Werk Otto Eckart KG, Munich, Germany

[22] Filed: Nov. 21, 1973

[21] Appl. No.: 418,082

[30] Foreign Application Priority Data

Nov. 23, 1972 Germany ..... 2257459

[52] U.S. Cl. ..... 426/111; 229/51 TS; 229/87 F; 426/122; 426/128

[51] Int. Cl.[2] ..... A21D 10/02

[58] Field of Search ..... 229/87 F, 87 R, 51 TS; 426/122, 123, 128, 389, 111

[56] References Cited

UNITED STATES PATENTS

| | | | |
|---|---|---|---|
| 1,436,754 | 11/1922 | Chadwick | 229/87 F |
| 2,112,143 | 3/1938 | Costa et al. | 229/51 TS |
| 2,200,111 | 5/1940 | Bensel | 229/87 F |
| 2,312,744 | 3/1943 | Barker | 229/87 R |
| 3,418,139 | 12/1968 | Craig | 426/123 X |

FOREIGN PATENTS OR APPLICATIONS

| | | | |
|---|---|---|---|
| 4,491 | 1/1892 | United Kingdom | 426/122 |

*Primary Examiner*—William Price
*Assistant Examiner*—Stephen P. Garbe
*Attorney, Agent, or Firm*—Anthony J. Casella

[57] ABSTRACT

A dumpling package is provided with a perforation arrangement for easily tearing-open and removing a package unit. The dumpling package is produced according to the tubular bag process, wherein the perforation is arranged at a spacing from the equator or is spirally surrounding the dumpling envelopment, with the perforation ending at a spacing from the poles.

7 Claims, 10 Drawing Figures

DUMPLING PACKAGE

BACKGROUND OF THE INVENTION

This invention relates to a dumpling package, in which a perforation is provided for easily tearing-open and removing a packaging unit, and more particularly to a dumpling envelopment produced according to the tubular bag process.

The packaging of food products in water-permeable, boilable containers, which are removed only after boiling and largely determine the shape of the ready-boiled food product, is already known from German patent No. 1,049,685, German patent No. 1,251,639, German Offenlegungsschrift 1,936,465, Austrian patent No. 248,845 as well as from German Gebrauchsmuster (petty patent) 69 4,9704. Moreover, thus packaged food products are already available on the market.

Of the above-indicated publications, only Austrian patent No. 248,845 and German Gebrauchsmuster 6,9 49,704 relate to packaging containers alone; suggestions for opening the packaging envelopment are also made therein. Austrian patent No. 248,845 describes a dumpling envelopment designed as bursting envelopment, thus bursts at a certain swelling pressure, whereas German Gebrauchsmuster 6,949,704 suggests a perforation arranged around the equator of the dumpling envelopment for facilitating opening.

It has become evident that arranging the perforation according to the suggestion of German Gebrauchsmuster 6,949,704 in dumpling envelopments of the tubular bag type involves drawbacks. Dumplings when being boiled produce a certain swelling pressure entailing substantial adherence of the dumpling to the perforated envelopment. Now if the perforation for tearing-open is disposed on the dumpling equator, the frictional resistance between filling material and envelopment will also have to be overcome in addition to the tearing-open resistance. Pulling strain in the direction of the pole seams will still additionally increase the pressure on the filling material possibly resulting in deformation of the dumpling.

It is the object of this invention to provide a dumpling envelopment having a perforation arrangement ensuring easy and convenient opening of such dumpling envelopments without the above-mentioned drawbacks.

This object is solved in connection with packaging materials having smooth surface by a circular perforation in the dumpling envelopment, said perforation being arranged at a spacing from the equator, whereas in the case of packaging materials having rough surface the dumpling envelopment is provided with a spiral perforation, with the perforation not being executed in one spiral operation (course) up to the two poles.

For example, polyethylene and polyethylene composite foils are suited as packaging materials having smooth surface. The circular perforation provided therein is preferably arranged at a spacing, which corresponds to half the distance between equator and pole of the dumpling.

Teabag paper and fleece foils are named as packaging materials having rough surfce. In the case of these materials, in which the dumpling will not slide out of the tubular envelopment as easily as in the case of smooth materials, the perforation preferably ends at a spacing from the poles, which corresponds to half the spacing between equator and pole.

The invention will be explained below with reference to the drawings:

FIGS. 1*a* and 1*b* shows a packaging unit as part of a tubular package, in which a circular perforation 5 is arranged at a spacing corresponding to half the distance between equator and pole of the dumpling. Reference numeral 4 designates the foil web, letter a designates the extended cooking bag length of the package of the dumpling or other food product capable of swelling, reference numeral 1 designates the longitudinal seam and reference numeral 2 designates the pole seams. In the diagrammatic view of a formed bag 3 for boiling shown on the right-hand side, it will be seen particularly clearly that perforation 5 is disposed at about half the spacing from the equator to the constriction at the pole seam 2.

FIGS. 2*a* and 2*b*, in which the same reference numerals designate the same parts, show a spiral perforation 5, which is not executed in one spiral course up to the two poles. The perforation only extends over about half the total spacing between the two poles, namely from about the center between equator and lower pole to about the center of the distance between equator and upper pole.

FIGS. 3*a* and 3*b* show a dumpling package with an additional perforation 5 extending oppositely to said first perforation 5 but not meeting it.

FIGS. 4*a* and 4*b* also show a dumpling package with an additional perforation, which covers slightly more than half the circumference of the dumpling always at half the distance from the top and bottom from the equator of the dumpling to the pole.

FIGS. 5*a* and 5*b* finally show two further spiral perforations 5 extending parallel to the center perforation 5 and also covering a distance only about equal to half the distance between the two poles.

The embodiment according to FIG. 1, which is particularly suited for smooth packaging materials, shows an arrangement of the perforation sufficient for tearing-off one pole cap. The perforation is extending annularly at the location at which lifting of the pole cap occurs upon slight stretching strain on pole seams 2. A somewhat expansible material will be selected, and due to this fact and due to the fact that also the contents are slightly deformable, the part of the package that is narrowed again round about the equator can also be easily pulled off the dumpling. Now only the resistance by the tearing-open perforation needs be overcome in order to tear open the envelope along perforation 5. The frictional forces between packaging material and filling material no longer take effect. By tearing-open the perforation, a tubular structure that is still slightly constricted only on one side results, along the smooth inside wall of which the dumpling can easily slide out.

In the embodiment according to FIG. 2, pulling action on the two pole ends will tear open the perforation preferably in the range of the pole caps, and the perforation will then continue to tear open following its spiral course (arrangement), thus imparting to the dumpling a rotary movement causing said dumpling to slip out of the envelopment. The rotary movement will loosen the content of the package also with a packaging material having rough surface, such as teabag paper or fleece foil.

In the embodiment according to FIG. 3, a second, interrupted spiral is extending oppositely to the first spiral of perforation 5, so that the tearing-open line as a whole is 8-configured. This makes it possible to easily and completely lift off the pole caps.

It is to be considered a further advantage of the present invention that no additional technical means are required for applying the perforations according to the invention, but that the same devices can be employed as for producing a perforation on the equator of a dumpling package. Usually, the packaging material is perforated still before it is formed to a tube (hose) by means of a perforation knife operating in time with the working cycle of the sealing- and filling device. The proper position of the perforation can now be fixed by correspondingly displacing the perforation knife. However, according to a particularly preferred embodiment of the invention, the position of the perforation can also be adjusted by providing a deviating roller between perforation tool and sealing device. This involves the advantage that the perforation tool can be fixedly mounted and nevertheless products of varying size can be filled-in.

Figure 1B:
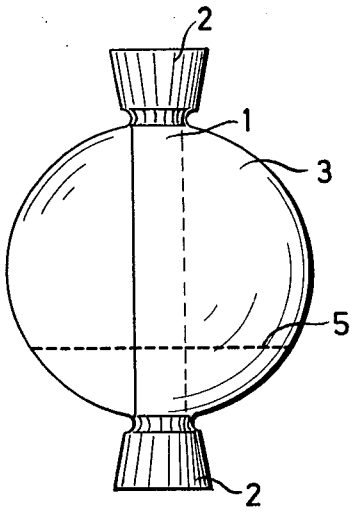
Figure 1A:
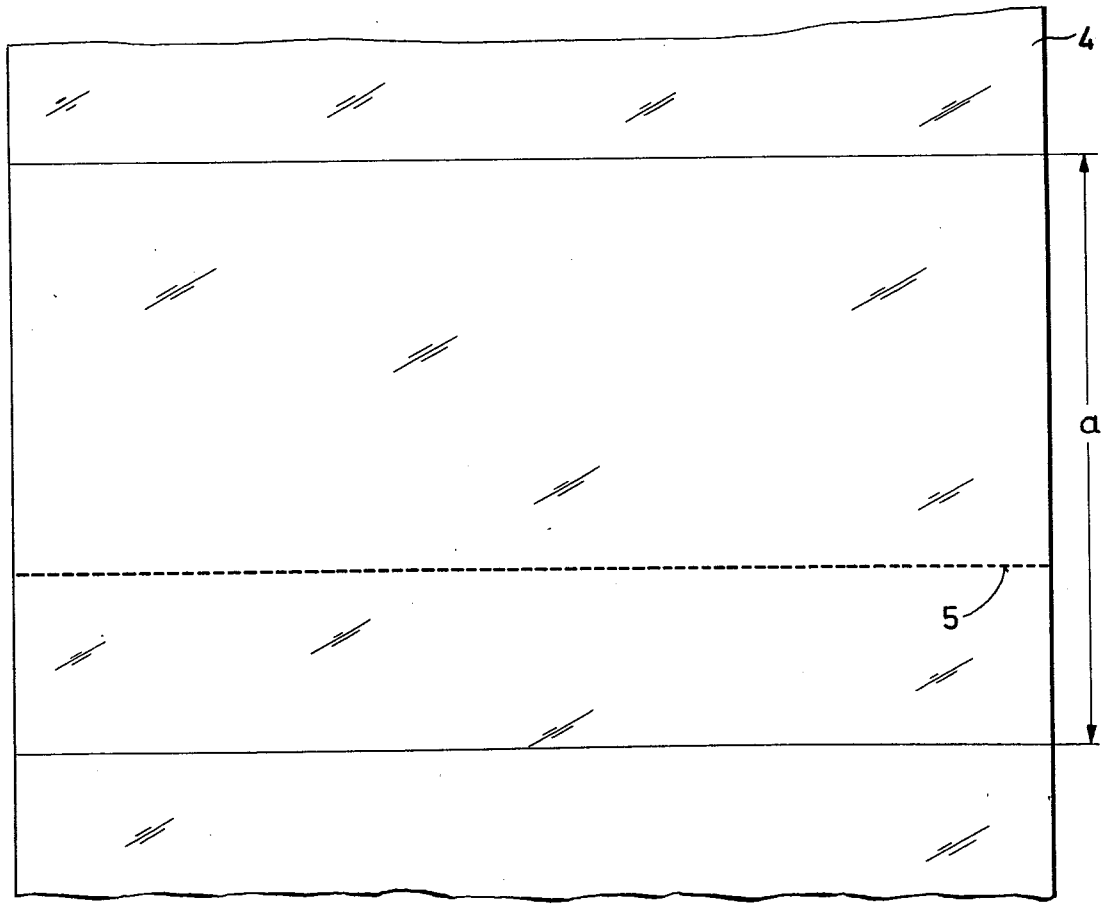
Figure 2B:
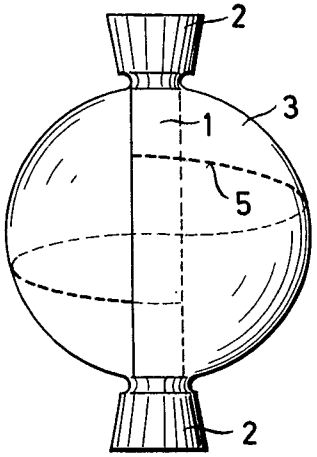
Figure 2A:
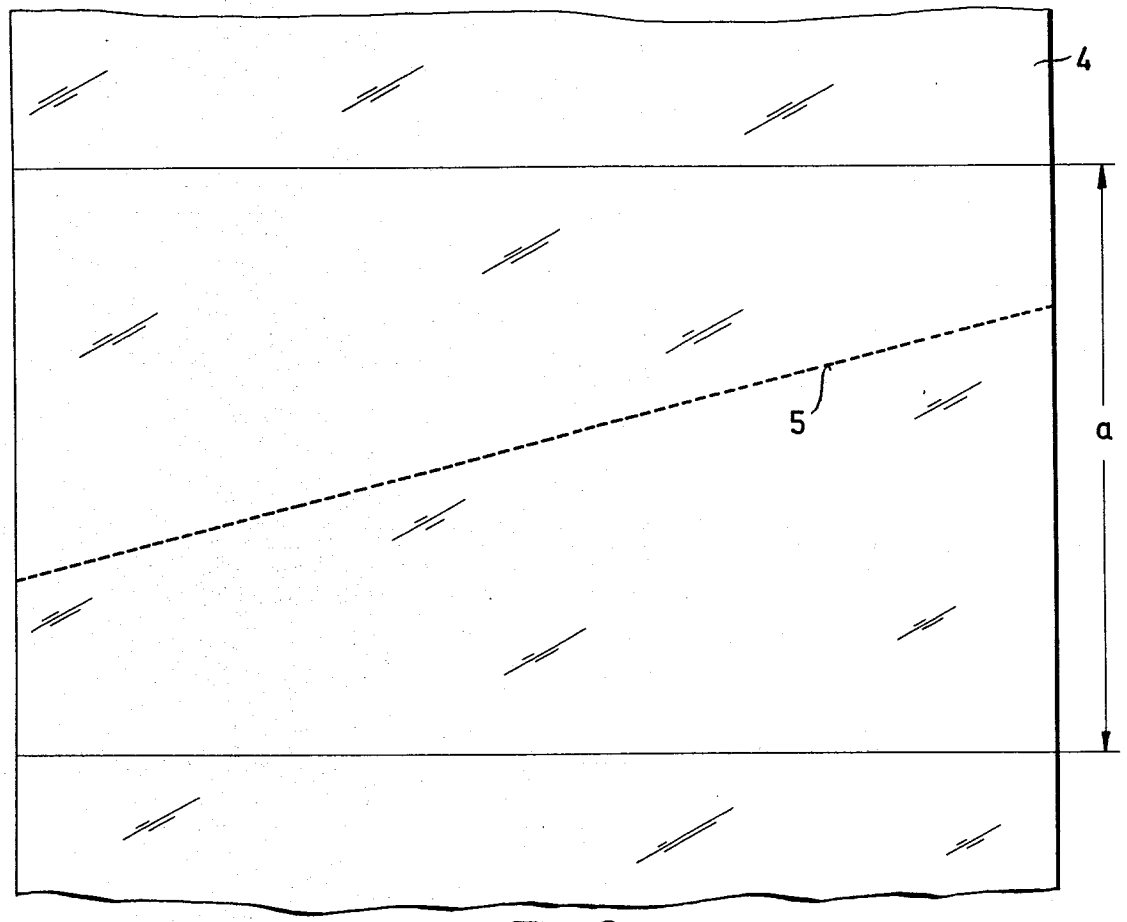
Figure 3B:
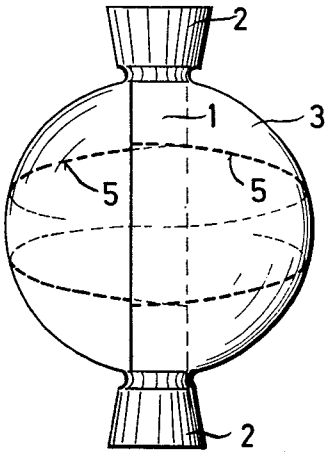
Figure 3A:
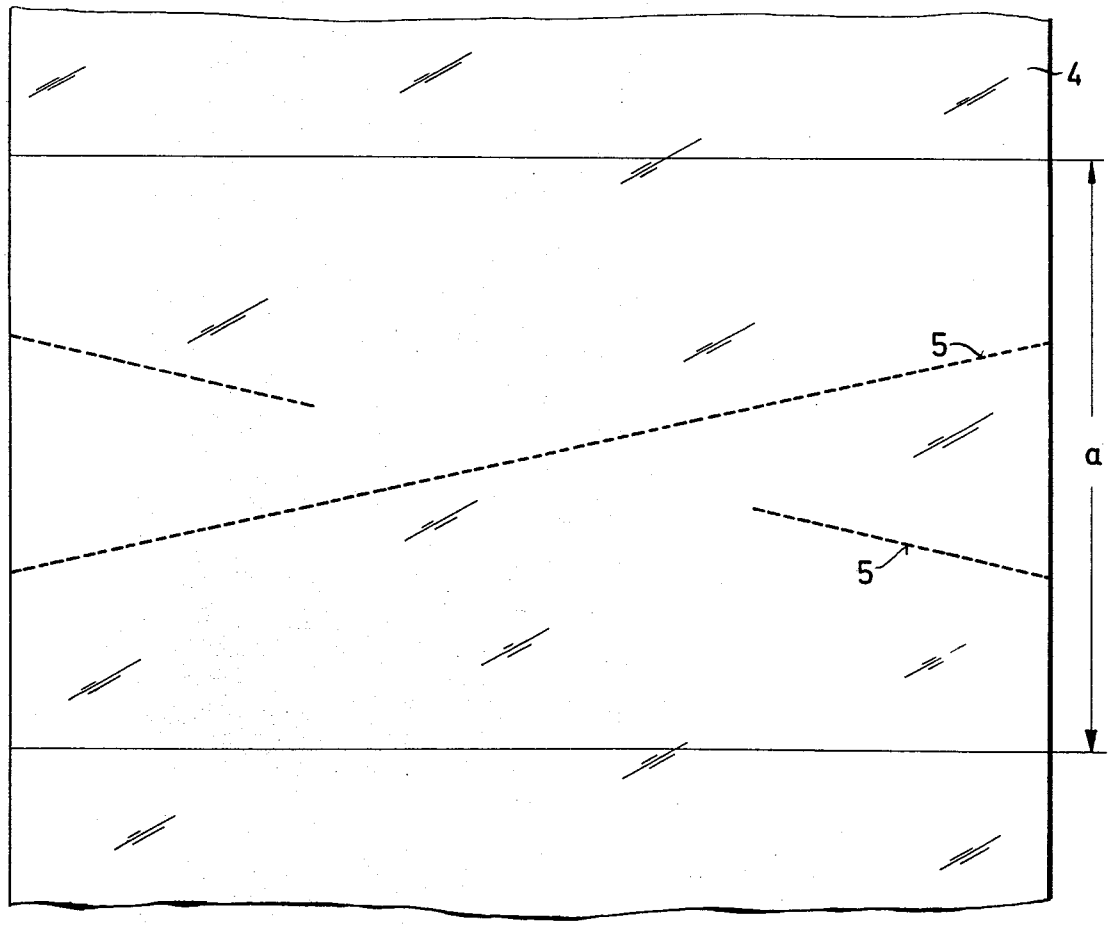
Figure 4B:
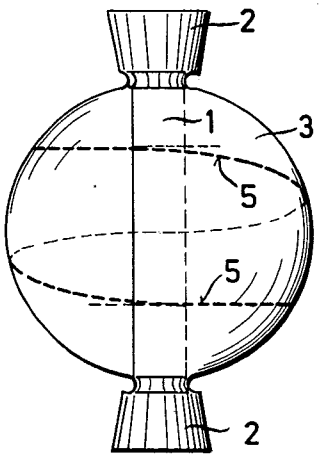
FIG. 4 shows a packaging unit, in which, in addition to the spiral perforation 5, a circular perforation 5 encompassing a little more than half or almost ⅔ of the circumference is provided always at half the distance between equator and pole of the dumpling and, thus, about at the upper and lower apex of the spiral, but without contacting said apex.
Figure 4A:
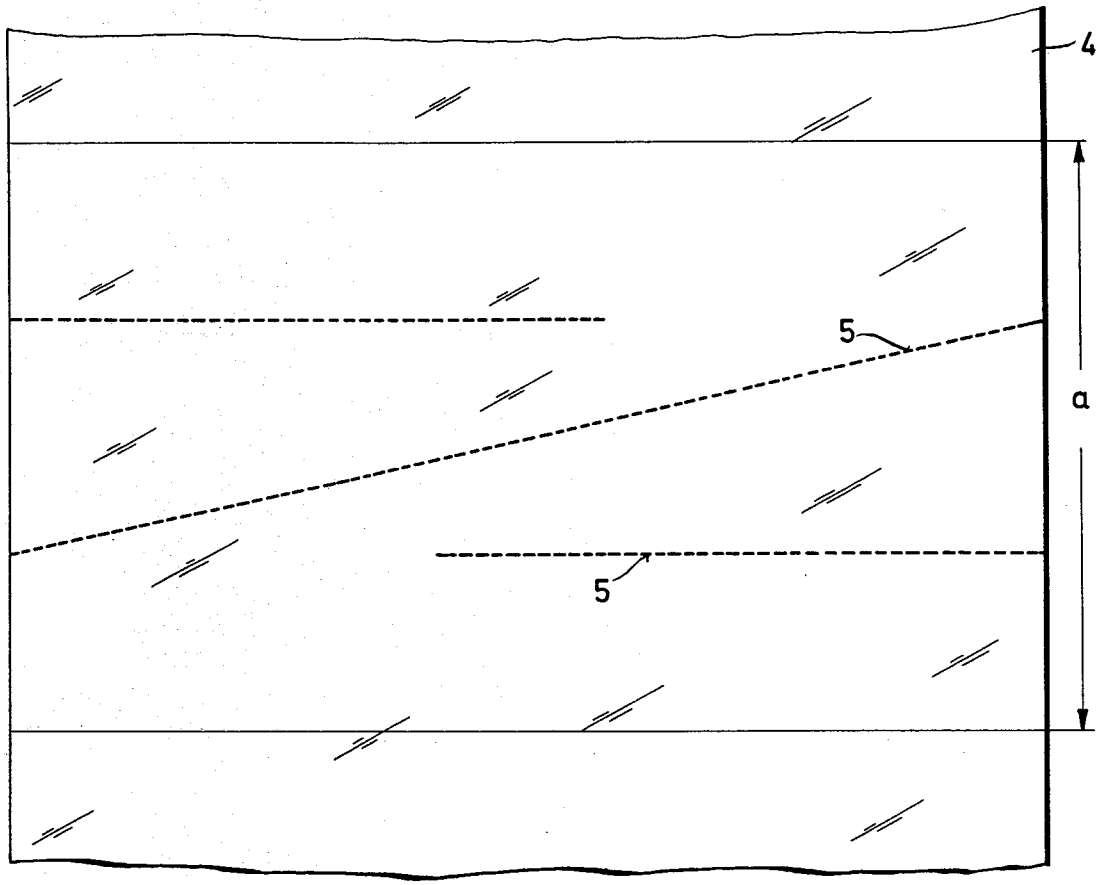
Figure 5B:
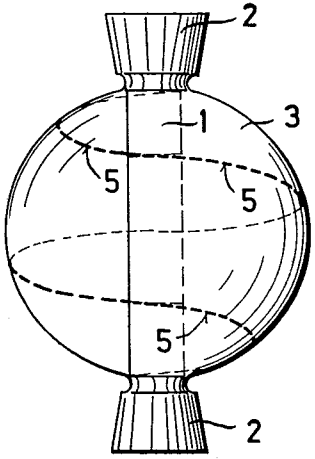
FIG. 5 shows an arrangement with three spiral perforations 5, each extending over about half the distance from pole to pole, thus as a whole constituting a twice interrupted spiral from the lower to the upper pole.
Figure 5A:
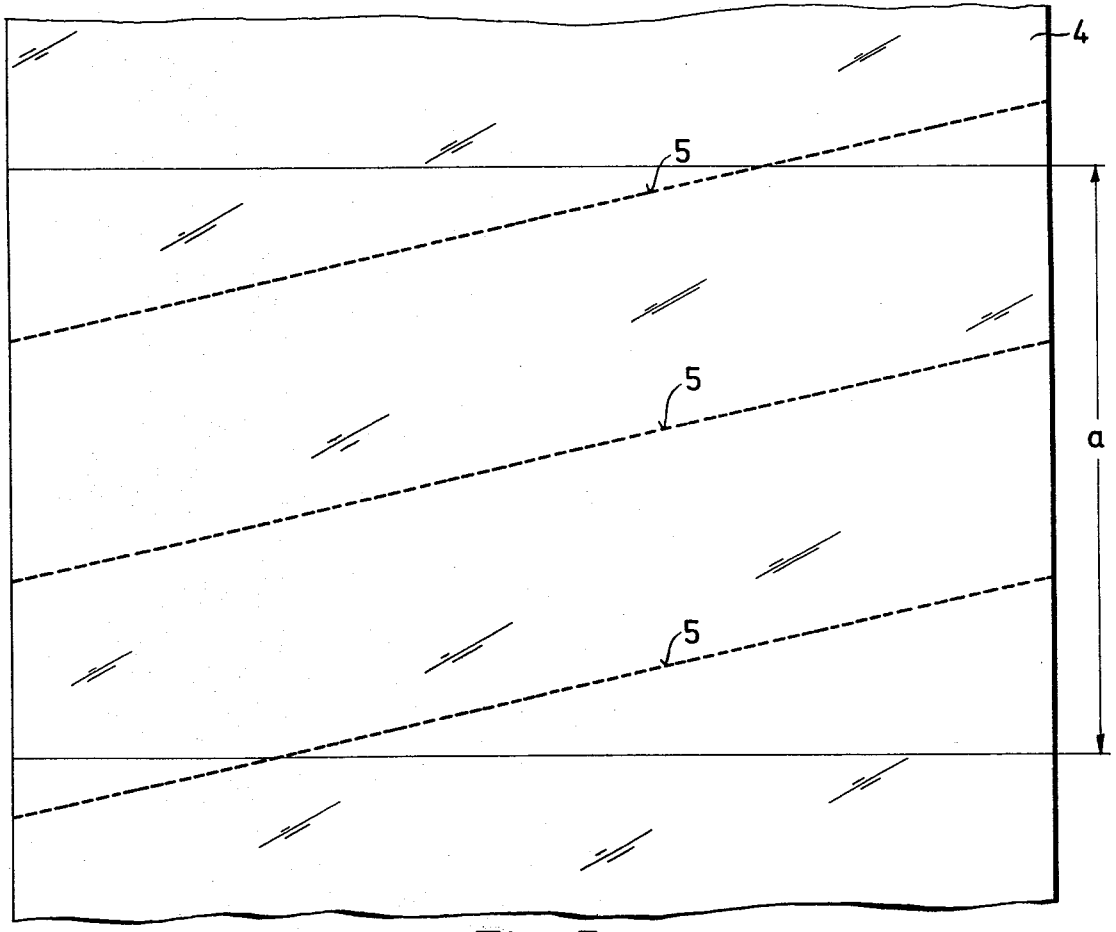

When producing the spiral tearing-open perforation, it is necessary to execute it at an angle to the vertical to the direction of movement of the packaging material, the amount of which angle depends upon the size of the filled product and is between the size 90 and smaller than 90, but preferably between 30° and 45° (FIG. 2–5).

It is as easy to effect widening of the spiral tearing-open perforation in that the perforation provided at an angle to the vertical in the direction of movement of the foil web is accompanied by a second perforation arranged at mirror-inverted angle or horizontally and, thus, vertically to the direction of movement of the foil web, said perforation, however, not spanning the entire foil width, but being executed always only over about one-third of the foil width starting from both edges. This embodiment provides a perforation largely encompassing both pole caps and considerably facilitating tearing-open of the perforation. It is avoided by the interruption of the second perforation in the center third of the foil web that only the pole caps are pulled off while the remainder of the packaging container adheres to the dumpling. The same advantage also is attained with the embodiment according to FIG. 5 having three parallel spirals.

We claim:

1. The combination of a food product such as a dumpling which swells to a spherical shape when boiled in water and a dumpling envelopment for storing and cooking said dumpling therein, said dumpling envelopment comprising a closed container made of an expansible sheet of teabag paper defining a spherical enclosure which contains said dumpling, said container including two integral pole seams disposed on diametrically opposed portions of said spherical enclosure, said closed container including at least one perforation extending across the surface of the spherical enclosure thereof, which perforation is offset with respect to an imaginary equator, circumferentially extending about the sperical enclosure, whereby after the dumpling has been cooked in the dumpling envelopment, and has expanded to a spherical shape so as to engage the interior of the spherical enclosure, the application of an axial pulling force on the opposed pole seams of the expansible envelopment separates the dumpling from the sperical enclosure in the vicinity of said perforation and tears the envelopment along said perforation without deforming the dumpling, thereby enabling the removal of the undeformed, cooked dumpling from the envelopment.

2. The combination as in claim 1 wherein said perforation is annular and is disposed parallel to said imaginary equator and located intermediate the imaginary equator and one pole seam of said enclosure.

3. The combination as in claim 2 wherein the plane extending through said perforation intersects the longitudinal axis extending from pole seam to pole seam at a point ⅓ the distance between said one pole seam and the radial center of said spherical enclosure.

4. The combination as in claim 1 wherein said perforation is spiral-shaped and extends angularly offset with respect to said imaginary equator, and over the middle half portion of the spherical enclosure from about half the distance between the imaginary equator and one pole seam to half the distance between said imaginary equator and the opposite pole seam of the spherical enclosure.

5. The combination as in claim 4 wherein said dumpling envelopment further includes a spiral perforation which is arranged opposite to the first perforation, and angularly offset with respect to said imaginary equator, and extends only over one-fourth the width of said sheet material.

6. The combination as in claim 1 wherein said perforation is spiral and angularly offset with respect to said imaginary equator, and further includes a second perforation extending horizontally at a spacing from the opposed pole seams which correspond to one-fourth the circular arc assumed between both the pole seams along the surface of the envelopment, and in that said horizontal second perforation covers between one-half to two-thirds the width of said sheet material.

7. The combination as in claim 1 wherein said perforation is spiral and angularly offset with respect to said imaginary equator, and wherein said sperical enclosure includes a further spiral perforation disposed parallel to the first spiral perforation at a spacing somewhat less than the spacing of the imaginary equator and one pole seam of the dumpling enclosure.

* * * * *